US009677364B2

(12) United States Patent
Tallini et al.

(10) Patent No.: US 9,677,364 B2
(45) **Date of Patent: *Jun. 13, 2017**

(54) RADIAL CONDUIT CUTTING SYSTEM AND METHOD

(71) Applicant: Otto Torpedo Inc., Titusville, PA (US)

(72) Inventors: Richard F. Tallini, Toledo, OH (US); Todd J. Watkins, Titusville, PA (US)

(73) Assignee: Otto Torpedo, Inc., Titusville, PA (US)

( * ) Notice: Subject to any disclaimer, the term of this patent is extended or adjusted under 35 U.S.C. 154(b) by 262 days.

This patent is subject to a terminal disclaimer.

(21) Appl. No.: 13/955,851

(22) Filed: Jul. 31, 2013

(65) Prior Publication Data

US 2014/0034315 A1 Feb. 6, 2014

Related U.S. Application Data

(60) Provisional application No. 61/741,960, filed on Jul. 31, 2012, provisional application No. 61/741,996, filed on Aug. 1, 2012.

(51) Int. Cl.

| | |
|---|---|
| ***E21B 29/02*** | (2006.01) |
| ***C06B 45/00*** | (2006.01) |
| ***F42D 1/045*** | (2006.01) |
| ***F42D 3/00*** | (2006.01) |
| ***C06B 33/00*** | (2006.01) |

(52) U.S. Cl.

CPC ..... *E21B 29/02* (2013.01); *C06B 33/00* (2013.01); *C06B 45/00* (2013.01); *F42D 1/045* (2013.01); *F42D 3/00* (2013.01); *Y10T 29/49117* (2015.01); *Y10T 29/49826* (2015.01)

(58) Field of Classification Search

CPC ..... E21B 29/02; B22D 7/104

See application file for complete search history.

(56) References Cited

U.S. PATENT DOCUMENTS

| | | | | |
|---|---|---|---|---|
| 2,736,261 A | | 2/1956 | Davis et al. | 102/23 |
| 2,998,704 A | | 9/1961 | Brazil et al. | 60/35.6 |
| 3,175,492 A | | 3/1965 | Reyne et al. | 102/28 |
| 3,347,721 A | * | 10/1967 | Jago | B22D 7/104 149/2 |
| 3,467,172 A | * | 9/1969 | Clem | B22D 27/04 164/122 |

(Continued)

*Primary Examiner* — Stephen M Johnson
*Assistant Examiner* — Joshua Semick
(74) *Attorney, Agent, or Firm* — Jonathan M. D'Silva; MMI Intellectual Property

(57) ABSTRACT

What is presented is a metal magnalium thermite pellet that is used to create heated gas. The metal magnalium thermite pellet is made to be inserted into the cutting apparatus that is used for cutting a conduit for oil, gas, mining, and underwater pressure sealed tool applications. To cut the conduit, the cutting apparatus radially projects a flow of heated gas from the internal surface of the conduit through to its external surface. The metal magnalium thermite pellet is also made to be inserted into the high power igniter that releasably secures to the cutting apparatus. Generally, the metal magnalium thermite pellet comprises a metal magnalium thermite composition that consists of between 1 to 44 percent magnalium alloy, 1 to 44 percent aluminum, 40 to 60 percent iron oxide, and 10 to 20 percent polytetrafluoroethylene.

20 Claims, 10 Drawing Sheets

(56) References Cited

U.S. PATENT DOCUMENTS 3,503,814 A 3/1970 Helms, Jr. et al. ..... 149/109
3,565,706 A * 2/1971 Waite ..... C06B 33/02 102/364
3,695,951 A 10/1972 Helms, Jr. et al. ..... 149/19
3,713,636 A 1/1973 Helms et al. ..... 266/23 NN
3,890,168 A * 6/1975 Shumway ..... B23K 23/00 148/24
4,179,287 A * 12/1979 Kosto ..... C22C 1/02 420/413
4,298,063 A * 11/1981 Regalbuto ..... E21B 29/02 102/308
4,352,397 A * 10/1982 Christopher ..... C06B 33/02 149/44
4,424,086 A 1/1984 Christopher ..... 149/19.3
4,598,769 A 7/1986 Robertson ..... 166/55
4,619,318 A * 10/1986 Terrell ..... E21B 29/02 166/212
5,180,759 A * 1/1993 Neu ..... B22D 7/104 523/141
5,212,343 A * 5/1993 Brupbacher ..... C06B 33/00 102/302
5,372,069 A 12/1994 Hart et al. ..... 102/288
5,396,951 A 3/1995 Ross ..... 166/63
5,435,394 A 7/1995 Robertson ..... 166/382
6,186,226 B1 2/2001 Robertson ..... 166/55
6,360,808 B1 * 3/2002 Twardowska ..... B22C 9/082 164/359
6,598,679 B2 7/2003 Robertson ..... 166/297
6,925,937 B2 * 8/2005 Robertson ..... E21B 29/02 102/202
7,278,353 B2 * 10/2007 Langan ..... F42B 1/032 102/306
7,363,860 B2 4/2008 Wilson et al. ..... 102/205
7,632,365 B1 * 12/2009 D'Arche ..... C06B 33/12 149/37
7,727,347 B1 * 6/2010 Newman ..... C06B 21/0041 149/109.4
7,997,332 B2 8/2011 Robertson ..... 166/55
8,136,439 B2 * 3/2012 Bell ..... E21B 29/02 166/55
8,235,102 B1 8/2012 Robertson ..... 166/63

* cited by examiner

RADIAL CONDUIT CUTTING SYSTEM AND METHOD

This application takes priority from U.S. provisional application No. 61/741,960 filed Jul. 31, 2012, and from U.S. provisional application No. 61/741,996 filed Aug. 1, 2012, both of which are incorporated herein by reference.

BACKGROUND

In certain types of drilling operations, such as hydraulic fracturing, conduit strings will sometimes get stuck in the borehole through which the drilling is occurring. When this problem arises, it is necessary for the drilling operator to cut the conduit string as close to where the conduit is stuck as possible in order retract and salvage as much of the conduit as possible. A variety of conduit cutters are known in the prior art to perform this task. One in particular, gas forming thermite pipe cutters, ignite combustible pyrotechnic materials to create a radially directed flow of heated gas used to cut the conduit into two portions. However, the prior art systems use pyrotechnic materials and their associated cutting apparatuses tend to have problems that make the radial flow of heated gas unreliable, unpredictable, weak, and/or not uniform. Moreover, igniting the pyrotechnic materials in the prior art radial conduit cutting apparatuses is also a challenge in itself. What is presented is an improvement to the radial conduit cutting system, which create a more uniform, predictable, precise, and stronger radial flow of heated gas.

SUMMARY

What is presented is a metal magnalium thermite pellet for creating heated gas that can be used in a cutting apparatus for conduits. What is also presented is a cutting system comprising both a high power igniter and the cutting apparatus. The metal magnalium thermite pellet is made to be inserted into the cutting apparatus that is used for cutting a conduit for oil, gas, mining, and underwater pressure sealed tool applications. To cut the conduit, the cutting apparatus radially projects a flow of heated gas from the internal surface of the conduit through to its external surface. The metal magnalium thermite pellet is also made to be inserted into the high power igniter that releasably secures to the cutting apparatus.

Generally, the metal magnalium thermite pellet comprises a metal magnalium thermite composition that consists of between 1 to 44 percent magnalium alloy, 1 to 44 percent aluminum, 40 to 60 percent iron oxide, and 10 to 20 percent polytetrafluoroethylene. More specifically, the metal magnalium thermite pellet may comprise a metal magnalium thermite composition that is: 17.5 percent magnalium alloy, 17.5 percent aluminum, 50 percent iron oxide, and 15 percent polytetrafluoroethylene. The magnalium alloy typically has a composition of 50 percent magnesium and 50 percent aluminum, but this composition may be different. The metal magnalium thermite pellet could also be compacted to between 90 percent and 99 percent of its theoretical density. The metal magnalium thermite pellet could also have a circular cross-section, tubular length, and an axial hole through its central axis.

The cutting apparatus identified above comprises an elongated apparatus housing that has been adapted to drop down into and be positioned inside a conduit. The apparatus housing has a sleeve section, which is moved away from the rest of the apparatus housing by a flow of heated gas in the cutting apparatus that exists when the cutting apparatus is in use. When the sleeve section has moved sufficiently, a circumferential diverter gap is exposed that project the heated gas into the environment surrounding the cutting apparatus. The apparatus housing could be made from hardened steel.

The cutting apparatus also comprises a metal magnalium thermite pellet as identified above. This metal magnalium thermite pellet is inserted into the apparatus housing and creates the flow of heated gas when the cutting apparatus is in use. In certain instances, more than one metal magnalium thermite pellet could be inserted into the apparatus housing. The cutting apparatus comprises a nozzle assembly positioned in the apparatus housing. The cutting apparatus could comprise a heat shield interposed between the metal magnalium thermite pellet and nozzle assembly. The heat shield increases the pressure and velocity of the flow of the heated gas and directs this flow towards the nozzle assembly.

The nozzle assembly comprises a conical head that has a plurality of through holes. The through holes disperse the flow of the heated gas evenly throughout the nozzle assembly and increase the pressure and velocity of the flow of heated gas. The nozzle assembly also comprises a retainer, a diverter, and a spindle. The retainer abuts the diverter and could have a constrictor portion that helps to increase the pressure and velocity of the flow of heated gas as the flow passes over the diverter. The diverter increases the pressure and velocity of the flow of heated gas after the flow passes through the retainer and directs the flow of the heated gas to project radially from the exposed circumferential diverter gap. The diverter could have a chamfer that increases the pressure and velocity of the flow of heated gas after the flow passes through the retainer. The spindle provides structure and maintains the position of the nozzle assembly inside the apparatus housing.

The high power igniter that releasably secures to a cutting apparatus, as described above, comprises an igniter housing that has been adapted to drop down into and be positioned inside the conduit. The igniter housing comprises both a containment sub and a nozzle sub, which releasably secure to each other. The igniter housing could be made from hardened steel. The nozzle sub directs the flow of the heated gas toward the cutting apparatus and releasably secures to the cutting apparatus. The containment sub could secure to a cable head assembly that connects the high power igniter to an external power source.

The high power igniter also comprises a high wattage heater contained in the igniter housing. The high wattage heater comprises a metal magnalium thermite pellet, as described above, and a pellet igniting device. This metal magnalium thermite pellet is inserted into the igniter housing and creates a flow of heated gas when the high power igniter is in use. The high wattage heater could comprise a fireproof and non-conductive heat tube. A containment seal could be inserted into the high power heater. The containment seal securely positions the metal magnalium thermite pellet inside the igniter housing as well as prevents the pellet igniting device from making contact with either the nozzle sub or the containment sub.

In certain instances, the pellet igniting device is a length of resistance wire. The high wattage heater further comprises an insulation sleeve, which has an electrical contact. The insulation sleeve encapsulates the metal magnalium thermite pellet and ensures the flow of heated gas is directed correctly. The insulation sleeve also has an electrical contact. The high wattage heater also comprises a fireproof and non-conductive heat tube inside the insulation sleeve. In this instance, the pellet igniting device is affixed longitudinally around the perimeter of the heat tube. In other instances, the pellet igniting device is affixed externally around the heat tube.

The high wattage heater could also comprise a fireproof and non-conductive heat shaft inside the insulation sleeve. When the heat shaft is used, the pellet igniting device is affixed to the heat shaft and both are inserted through the axial hole of the metal magnalium thermite pellet. In other instances, the high wattage heater does not comprises the heat tube, but the pellet igniting device is directly affixed to the inner surface of the insulation sleeve or the pellet igniting device is directly affixed to the metal magnalium thermite pellet. Finally, the pellet igniting device could be a cartridge heater that is inserted into the axial hole of the metal magnalium thermite pellet.

What is also presented is a method of safely transporting a high power igniter and a cutting apparatus. The method of safely transporting the high power igniter comprises the steps of: conveying metal magnalium thermite pellets to a job site, conveying the high power igniter to the job site separately from the metal magnalium thermite pellets, and assembling the high power igniter at the job site by inserting a metal magnalium thermite pellet into the high power igniter. This method could also comprise the step of connecting the high power igniter to an external power source and using the external power source to activate the high power igniter. The method of safely transporting a cutting apparatus comprises the steps of: conveying metal magnalium thermite pellets to a job site, conveying the cutting apparatus to the job site separately from the metal magnalium thermite pellets, and assembling the cutting apparatus at the job site by inserting metal magnalium thermite pellets into the cutting apparatus. This method could also comprise the step of determining the number of metal magnalium thermite pellets to be inserted into the cutting apparatus based on the characteristics of the conduit to be cut.

What is also presented is a method of using the cutting apparatus comprising the steps of conveying a plurality of metal magnalium thermite pellets to a job site, conveying the cutting apparatus to the job site separately from the plurality of metal magnalium thermite pellets, determining the number of metal magnalium thermite pellets to be inserted into the cutting apparatus based on the characteristics of the conduit to be cut, and inserting at least one of the plurality of metal magnalium thermite pellets into the cutting apparatus based on the determination on the characteristics of the conduit to be cut. This method could also comprise the steps of positioning the cutting apparatus in the conduit to a location to be cut and activating the cutting device by sending a charge to the cutting device from an external power source.

Those skilled in the art will realize that this invention is capable of embodiments that are different from those shown and that details of the devices and methods can be changed in various manners without departing from the scope of this invention. Accordingly, the drawings and descriptions are to be regarded as including such equivalent embodiments as do not depart from the spirit and scope of this invention.

BRIEF DESCRIPTION OF DRAWINGS

For a more complete understanding and appreciation of this invention, and its many advantages, reference will be made to the following detailed description taken in conjunction with the accompanying drawings.

DETAILED DESCRIPTION

Figure 1:
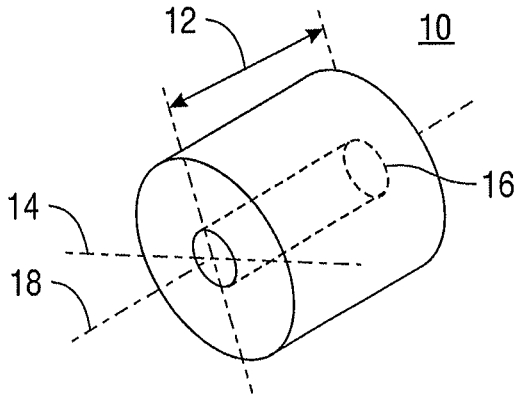
FIG. 1 shows a perspective view of a metal magnalium thermite pellet.
Figure 2:
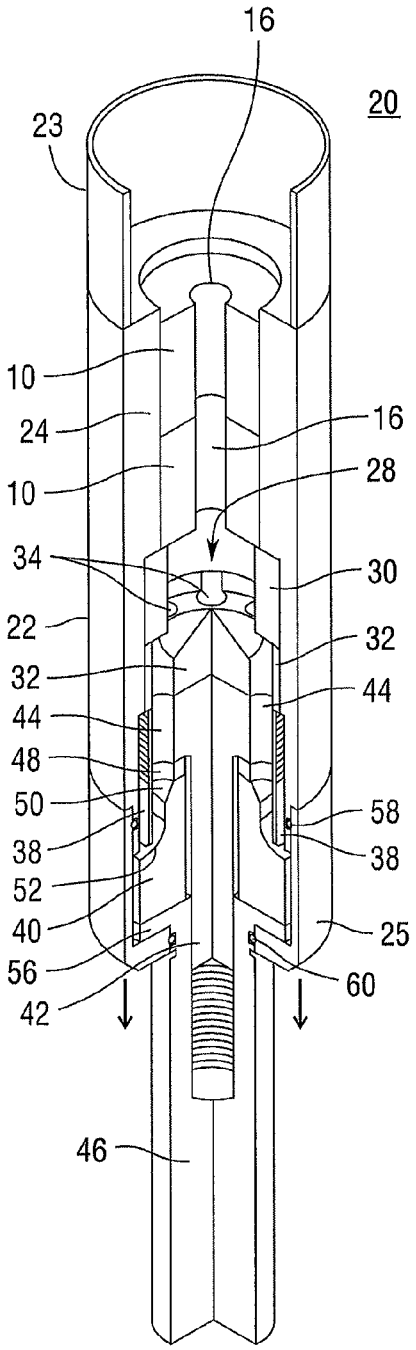
FIG. 2 shows a perspective cut-out view of a cutting apparatus for radially projecting a flow of heated gas.
Figure 3:
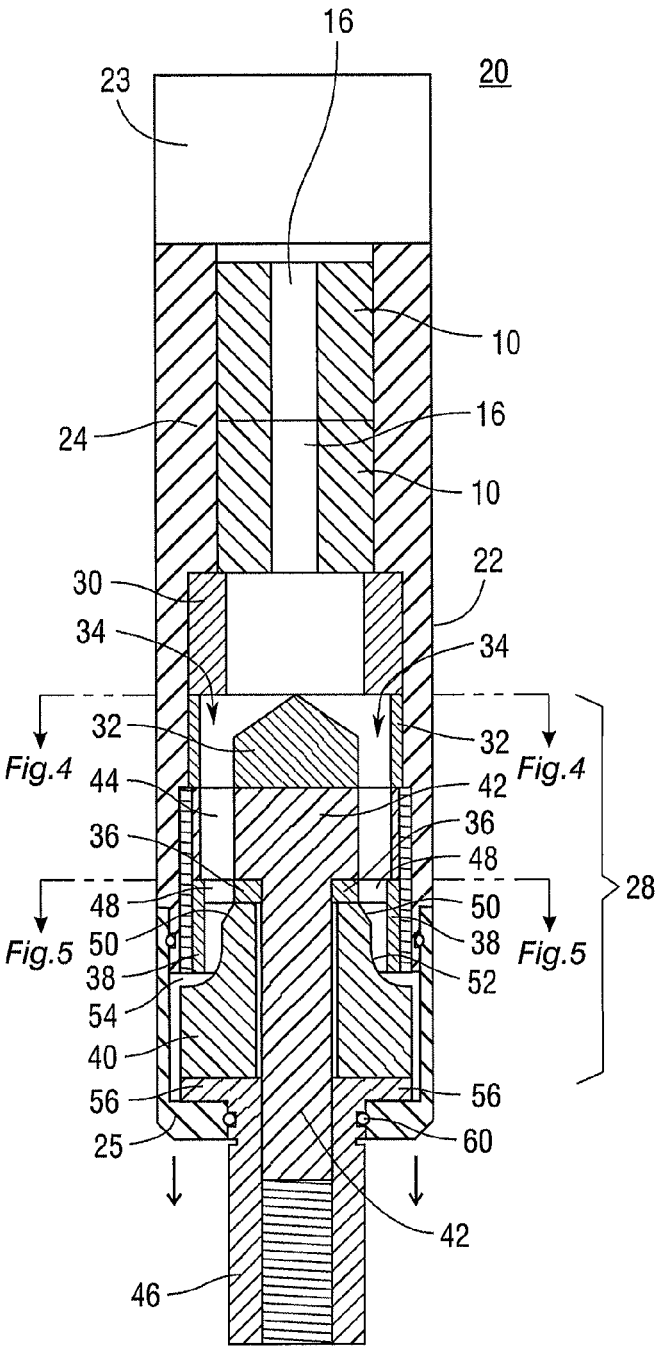
FIG. 3 shows a cross-sectional side view of the cutting apparatus of FIG. 2.
Figure 4:
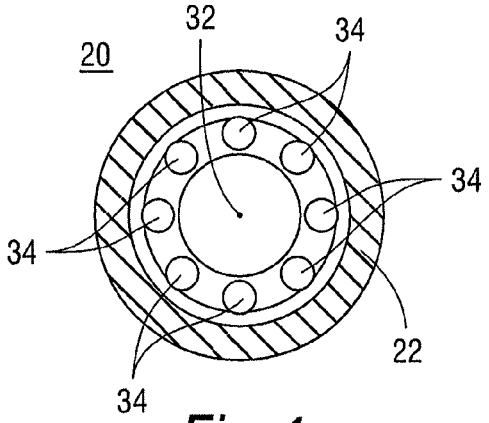
FIG. 4 shows a cross-sectional top view of the cutting apparatus of FIG. 2, as depicted by the hatch lines disclosed in FIG. 3.
Figure 5:
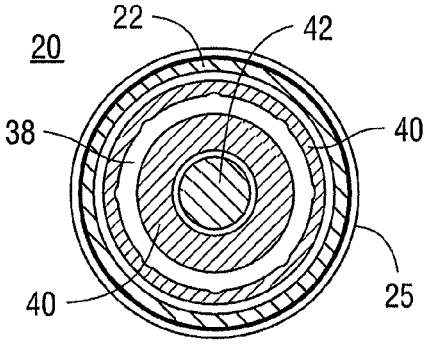
FIG. 5 shows a cross-sectional top view of the cutting apparatus of FIG. 2, as depicted by the hatch lines disclosed in FIG. 3.
Figure 6:
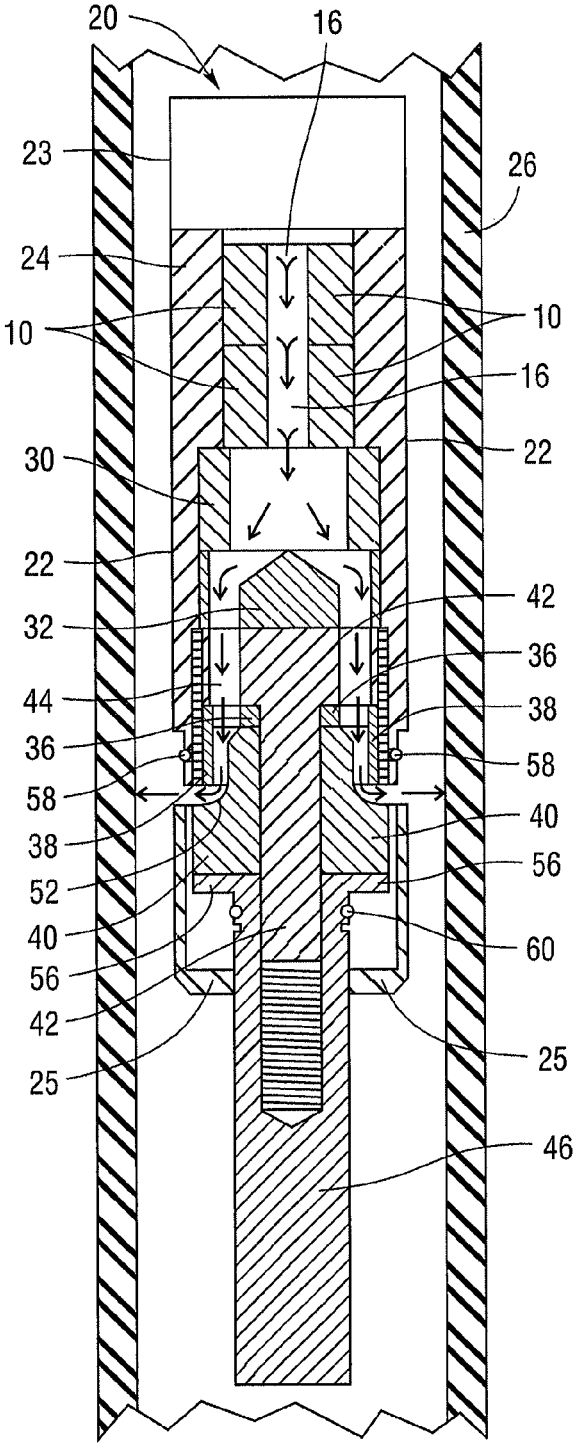
FIG. 6 shows a cross-sectional side view of the cutting apparatus of FIG. 2 in a conduit as well as the flow path of the heated gas through the cutting apparatus.

Referring to the drawings, some of the reference numerals are used to designate the same or corresponding parts through several of the embodiments and figures shown and described. Corresponding parts are denoted in different embodiments with the addition of lowercase letters. Variations of corresponding parts in form or function that are depicted in the figures are described. It will be understood that variations in the embodiments can generally be interchanged without deviating from the invention.

In many drilling operations for oil, gas, mining, and underwater pressure sealed tool applications, a conduit string is used to drill a well bore into the surface of the earth. The conduit string is typically a length of conduit, such as drill pipe, extending from the earth's surface drilling the well bore as it moves through the earth.

During drilling operations, the conduit string may become stuck in the borehole. If the conduit string cannot be removed, then it must be cut at the location as near as where the conduit is stuck as possible. Cutting the conduit string using a cutting system discussed below, involves lowering the cutting system inside the conduit string and activating the cutting system. This causes a radially projected flow of heated gas to cut the conduit from the internal surface of the conduit through the external surface of the conduit, completely severing the conduit string into two portions. The portion above the borehole can be removed for reuse in another well bore. It should be understood there may be other situations needing to implement this cutting system, which are different from the salvage operation discussed above.

Thermite pellets have been used to create flows of heated gas in radial conduit cutting apparatuses of cutting systems in the prior art. Generally these thermite pellets comprise thermite formulas that have compositions comprising some combination of: aluminum, magnesium, cupric oxide, and iron oxide; or, some combination of: nickel, aluminum, magnesium, and iron oxide; or, some combination of: nickel aluminum, iron oxide, and polytetrafluoroethylene (known as TEFLON); or, some combination of: aluminum, iron oxide, and polytetrafluoroethylene. A problem associated with thermite pellets comprising any of the above thermite formulas is that, although the thermite formula creates a flow of heated gas strong enough to cut through a conduit, the flow of heated gas also produces a slag formation inside the cutting apparatus. This slag builds up and can clog the through holes and like components of the cutting assembly. In many instances, these clogs prevent uniform radial flow of heated gas as it exits the cutting apparatus. This is a problem since the conduit must be cut around its entire circumference or the conduit will likely not be severable. In the past, to fix the problems associated with slag buildup, the prior nozzle assemblies comprised an upper truncated cone mixing chamber and a lower mixing chamber to help to reduce slag buildup and increase efficiency.

Through empirical testing, it has been found that replacing a portion of the aluminum in a thermite composition comprising aluminum, iron oxide, and polytetrafluoroethylene with a magnalium alloy, the heat output of the heated gas is greatly increased while also reducing the formation of slag as a byproduct. This magnalium alloy being used generally comprises 50 percent magnesium and 50 percent aluminum. It should be noted that using the exact mixture ratio of the separate metals aluminum and magnesium as in the metal magnalium thermite composition fails to yield the same high heat output results and reduced slag formation. It is theorized that the increased energy output is or could be the result of the magnalium alloy having a closer intermolecular bond than a simple mixture of the two elements. The preferred thermite composition of this new formula contains 17.5 percent magnalium alloy, 17.5 percent aluminum, 50 percent iron oxide, and 15 percent polytetrafluoroethylene. But thermite compositions containing somewhere between 1 to 44 percent magnalium alloy, between 1 to 44 percent aluminum, between 40 to 60 percent iron oxide, and between 10 to 20 percent polytetrafluoroethylene, will produce stronger heat outputs and less slag than the compositions found in the prior art. It should also be understood that the magnalium alloy may comprise a different ratio of magnesium to aluminum.

Igniting metal magnalium thermite pellets comprising this new formula within a high power igniter ensures there will be a flow of heated gas powerful enough to ignite the metal magnalium thermite pellets in the cutting apparatus to which the high power igniter is releasably secured, as discussed below. Igniting metal magnalium thermite pellets comprising this formula also ensures the heat output of the radial flow of heated gas projected from the cutting apparatus is strong enough to cut completely though the conduit to be cut. The reduction in slag produced also ensures the radial flow of heated gas from the cutting apparatus is uniform and will make contact with the entire circumference of the conduit to be cut because each of the through holes and like elements will not get clogged, alleviating the need for the prior art upper truncated cone mixing chamber and lower mixing chamber components in the cutting apparatus all together.

As shown in FIG. 1, the metal magnalium thermite pellets 10 are made to be inserted into a containment area in the apparatus housing of a cutting apparatus (shown and discussed below) and the containment sub of a high power igniter (shown and discussed below) of the cutting system. Generally, each metal magnalium thermite pellet 10 has a tubular length 12 and a circular cross-section 14 so they can securely fit into the cutting apparatus and high power igniter. However, if a certain application calls for the metal magnalium thermite pellet 10 to comprise a different shape, it should be understood that the metal magnalium thermite pellet 10 may comprise a length 12 that is not tubular and/or a cross-section 14 that is not circular. It should also be understood that the metal magnalium thermite pellet 10 could have a tubular length 12 that is elongated beyond the one disclosed, for particular applications. An axial hole 16 is burrowed through the central axis 18 of the metal magnalium thermite pellet 10 so there will be more surface area for creating heated gas when the metal magnalium thermite pellet 10 has been ignited in the radial cutting apparatus and/or high power igniter. Larger surface areas cause the metal magnalium thermite pellet 10 to create a stronger flow of heated gas more rapidly. The metal magnalium thermite pellets 10 are sized to have just enough side clearance to allow easy loading into the cutting apparatus described herein. This has the added benefit of allowing the entire surface area of the metal magnalium thermite pellets 10 to be exposed to combustion. This side clearance in combination with the axial hole 16 provides two pathways for the high pressure hot gasses to flow which allows for a faster combustion of the metal magnalium thermite pellets 10 than with prior art powdered ignition material. In contrast, loose powdered ignition materials tends to fill up gaps in the cutting apparatus, cutting off the pathways of hot gas flows, and slowing down the combustion. This results in uneven pressure buildup and reduced cutting ability compared to the metal magnalium thermite pellets 10 described herein.

The metal magnalium thermite pellet 10 is generally compressed, to be compacted between 90 percent and 99 percent of its theoretical density. Compressing the metal magnalium thermite pellet 10 to these theoretical densities allows for the metal magnalium thermite pellet 10 to produce a very powerful flow of heated gas in a smaller amount of space than if not compacted. Compression of this magnitude also makes the metal magnalium thermite pellet 10 highly resistant to mechanical damage caused by its normal handling. If the metal magnalium thermite pellet 10 is dropped on a concrete floor, it should not break or chip. The metal magnalium thermite pellet 10 is also more resistant to being ignited by any local source when they have been compacted to this density, making the metal magnalium thermite pellet 10 safer for transportation and storage purposes, as discussed in more detail below. However, it should be understood that the benefits of compacting the metal magnalium thermite pellet 10 to between 90 percent and 99 percent of its theoretical density may still be seen when the pellet has been compacted to theoretical densities below 90 percent.

Compressing the metal magnalium thermite pellet 10 allows one having ordinary skill in the art to know the exact burning surface area of the metal magnalium thermite pellet 10, making it possible to determine certain propulsion characteristics of the flow of heated gas. One such characteristic is Klemmung (Kn), which is the ratio between the total burning surface area of the compressed metal magnalium thermite pellet 10 divided by the total exit cross-sectional surface area. Kn is described by the equation:

$$Kn = \frac{A_b}{A_t}$$

where $A_b$ is the total burning surface area of the metal magnalium thermite pellets 10 and $A_t$ is the cross-sectional surface area of any exit flow path in the cutting system. Kn is directly related to the chamber pressure, pressure of the flow of heated gas, in the exit flow paths throughout the cutting system. One having ordinary skill in the art will see that making design changes to the metal magnalium thermite pellet 10, by changing its geometry, or by changing the cross-sectional surface area of any exit flow path within the cutting system, the chamber pressure within the cutting system can be manipulated. After being ignited, the metal magnalium thermite pellet 10 burns from its exposed surfaces to the interior. Since the metal magnalium thermite pellet 10 is regressive burning, the greatest amount of Kn, creating the greatest chamber pressure, is found at the ignition of the metal magnalium thermite pellet 10 and the lowest amount of Kn is found at the end of its burn. It is also understood from a design perspective, that performing calculations of the burn rate of metal magnalium thermite pellets 10 of known geometry is much easier than with loose powdered thermite whose surface areas are difficult to calculate. Furthermore, loose powders comprise large surface areas that produce Kn values in the thousands which are explosive in nature rather than propulsive which indicates that metal magnalium thermite pellets 10 have more controllable and predictable performance.

In the past, cutting systems of the prior art did not manipulate the cross-sectional surface area of the flow paths within the cutting system to facilitate an increase in chamber pressure. These prior art cutting systems, in fact, decreased the chamber pressure of the flow of heated gas as it flowed throughout the cutting system by enlarging certain sections of the cross-sectional surface area of the flow paths. Decreasing the chamber pressure in this manner weakens the flow of heated gas before it is projected radially from the cutting system, making the radially projected flow of heated gas less efficient for conduit cutting purposes. The cutting apparatus of the cutting system, discussed below, harnesses these chamber pressure characteristics to progressively increase the pressure and velocity of the flow of heated gas while traveling through the cutting apparatus.

As shown in FIGS. 2 through 6, this embodiment of the cutting apparatus 20 element of the entire cutting system (shown and discussed below) is manufactured to progressively and incrementally build the pressure and velocity of the flow of heated gas prior to being projected radially from the cutting apparatus 20. An elongated apparatus housing 22, made from hardened steel, is adapted to be positioned in a conduit 26. The apparatus housing 22 is elongated to contain enough metal magnalium thermite pellets 10 within it, to produce a flow of heated gas strong enough to cut through varying conduits 26. The number of metal magnalium thermite pellets 10 is preselected depending on the characteristics of the conduit 26. The length and/or surface geometry of the metal magnalium thermite pellets 10 could also be manipulated based on the characteristics of the conduit 26 to be cut. The length of the apparatus housing 22 can also be varied to accommodate a different number of metal magnalium thermite pellets 22 as needed for the particular application.

The apparatus housing 22 has a heavy walled portion 24, a movable sleeve section 25, and an igniter docking section 23. The heavy walled portion 24 holds a plurality of metal magnalium thermite pellets 10 in their respective positions in the apparatus housing 22 of the cutting apparatus 20. As further discussed below, the igniter docking section 23 allows a high power igniter (shown and discussed below) to releasably and slidably secure to one end of the cutting apparatus 20. After the metal magnalium thermite pellets 10 are ignited, by the high power igniter, the generated flow of heated gas travels down into the apparatus housing 22 and directly through the axial hole 16 of each metal magnalium thermite pellet 10. The flow of heated gas also expands around the sides of the metal magnalium thermite pellets 10 and looks for a place to escape in those locations. Surrounding the metal magnalium thermite pellets 10, the heavy walled portion 24 of the apparatus housing 22 does not expand outward so as to enforceably direct the entire flow of heated gas towards a nozzle assembly 28.

Prior to reaching the nozzle assembly 28, the flow of heated gas passes through a heat shield 30, which is interposed between the metal magnalium thermite pellets 10 and the nozzle assembly 28. The heat shield 30 has a narrower inner cross-sectional surface area than the inner cross-sectional surface area of the heavy walled portion 24 of the apparatus housing 22. This narrower cross-sectional surface area causes an increase in the Kn, progressively increasing the pressure and velocity of the flow of heated gas as it is directed towards the nozzle assembly 28.

The nozzle assembly 28 comprises a conical head 32, which includes a plurality of through holes 34, a retainer 36, which includes a constrictor portion 38, a diverter 40, a spindle 42, which includes a through hole extension portion 44, and an end cap 46. Upon reaching the nozzle assembly 28, the flow of heated gas is split apart radially and directed by the conical head 32 into each of the through holes 34. The plurality of through holes 34 distribute the flow of heated gas evenly throughout the entire nozzle assembly 28. Once in each of the through holes 34, the narrow cross-sectional surface area of each through hole 34 causes another increase in Kn, progressively increasing the pressure and velocity of the distributed flow of heated gas while passing through its respective through hole 34. After initially passing through each through hole 34, the flow of heated gas passes through the through hole extension portion 44 of the spindle 42, which is lined with heat resistant material. The through hole extension portion 44 has its own plurality of burrowed openings aligning with and extending the through holes 34 to the retainer 36.

Once passing beyond burrowed openings of the through hole extension portion 44, the distributed flow of heated gas then reaches the retainer 36, which abuts the diverter 40. The retainer has a plurality of burrow holes 48 through it, aligning with and extending the burrowed through holes 34 of the conical head 32 and the through hole extension portion 44 of the spindle 42. The burrow holes 48 on the retainer 36 have a narrower cross-sectional surface area than through holes 34 and burrowed openings of the through hole extension portion 44, effectively increasing the Kn and thereby further increasing the pressure and velocity of the distributed flow of heated gas as it passes through the burrow holes 48.

Once passing through the burrow holes 48, the distributed flow of heated gas is abruptly tapered into the region over the diverter 40 and under the constrictor portion 38 by a chamfer 50 on the diverter 40. The chamfer 50 increases the Kn, abruptly increasing the pressure and velocity of the distributed flow of heated gas before it passes over the rounded surface portion 52 of the diverter 40. The chamfer 50 is a beveled edge connecting the edge of the diverter 40 abutting the retainer with the rounded surface portion 52 of the diverter 40.

After passing beyond the chamfer 50, the constrictor portion 38 and diverter 40 work in conjunction to create a channel that further increases the Kn, increasing pressure and velocity of the distributed flow of heated gas passing through this area. In this area the Kn is at its highest level in the cutting apparatus 20. The pressure and velocity of the distributed flow of heated gas is so high that it causes the distributed flow of heated gas passing out of the individual burrow holes 48 to immediately flow back together, returning to a singular flow, as if the flow wasn't distributed by the plurality of through holes 34 anywhere in the cutting apparatus 20. Bringing the flow back together in this manner increases the strength of the flow of heated gas. The flow of heated gas is then directed by the rounded surface portion 52 of the diverter 40 outward, to project radially through a circumferential diverter gap 54 formed by the space between the end tip of the constrictor portion 38 and edge of the rounded surface portion 52 of the diverter 40. The circumferential diverter gap 54 allows the flow of heated gas to cut through and sever the conduit 26 in a very concentrated and narrow area.

If the sleeve section 25 is in the closed position when the flow of heated gas projects radially through the circumferential diverter gap 54, the flow of heated gas forces the sleeve section 25 to move downward and away from the rest of the apparatus housing 22 and into the open position. With the sleeve section 25 in the open position, the circumferential diverter gap 54 is exposed to the surrounding environment and the flow of heated gas is free to flow radially from the cutting apparatus 20 and act directly upon the conduit 26.

The spindle 42 provides structure for the nozzle assembly 28 in the apparatus housing 22 and maintains the positioning of the nozzle assembly 28. The spindle 42 allows the nozzle assembly 28 to remain stationary while the flow of heated gas passes through. The diverter 40 is positioned entirely on the spindle 42. The end cap 46 is threadably secured to the spindle 42 and holds the diverter 40 in position against the retainer 36. A shoulder portion 56 on the end cap 46 supports the diverter 40 and meets the sleeve section 25. When in the closed position, the sleeve section 25 mates smoothly with the apparatus housing 22 and keeps the cutting apparatus 20 water tight through the o-rings 58 and 60. It will be understood that the various cross-sectional surface areas that the flow of heated gas must flow through in the cutting apparatus 20 are designed to progressively increase the pressure and flow rate of the heated gas to achieve progressively higher Kn values. The final effect is that the ejected heated gasses generated by the system described herein are higher in temperature and pressure than prior art systems.

Figure 7:
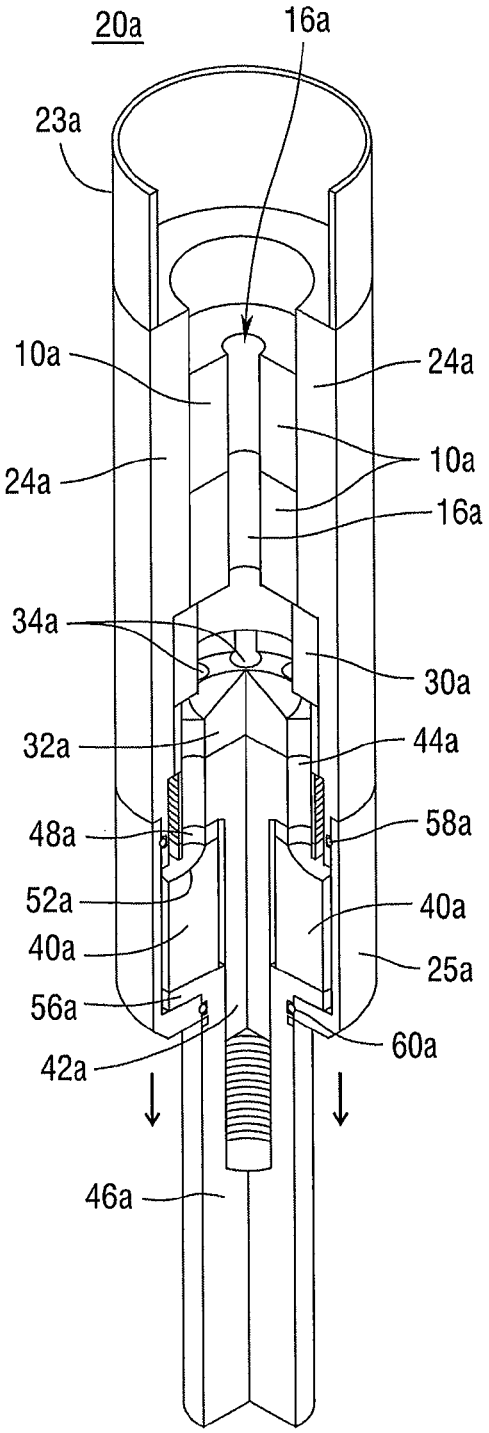
FIG. 7 shows a perspective cut-out view of another embodiment of the cutting apparatus.
Figure 8:
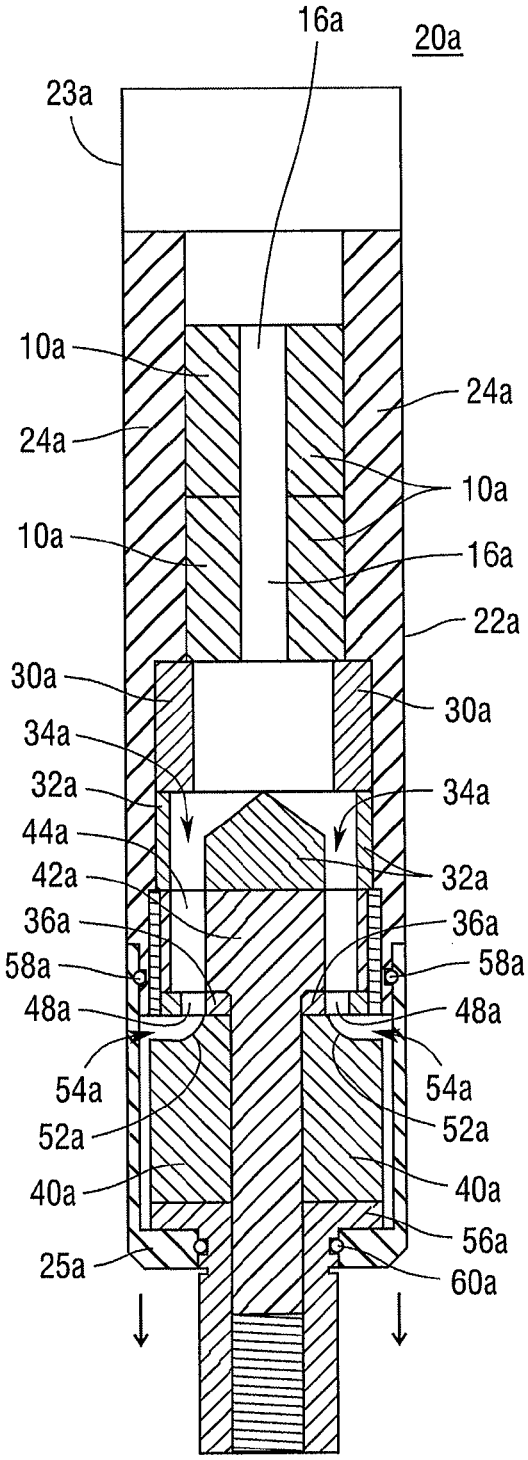
FIG. 8 shows a cross-sectional side view of the cutting apparatus of FIG. 7.
Figure 9:
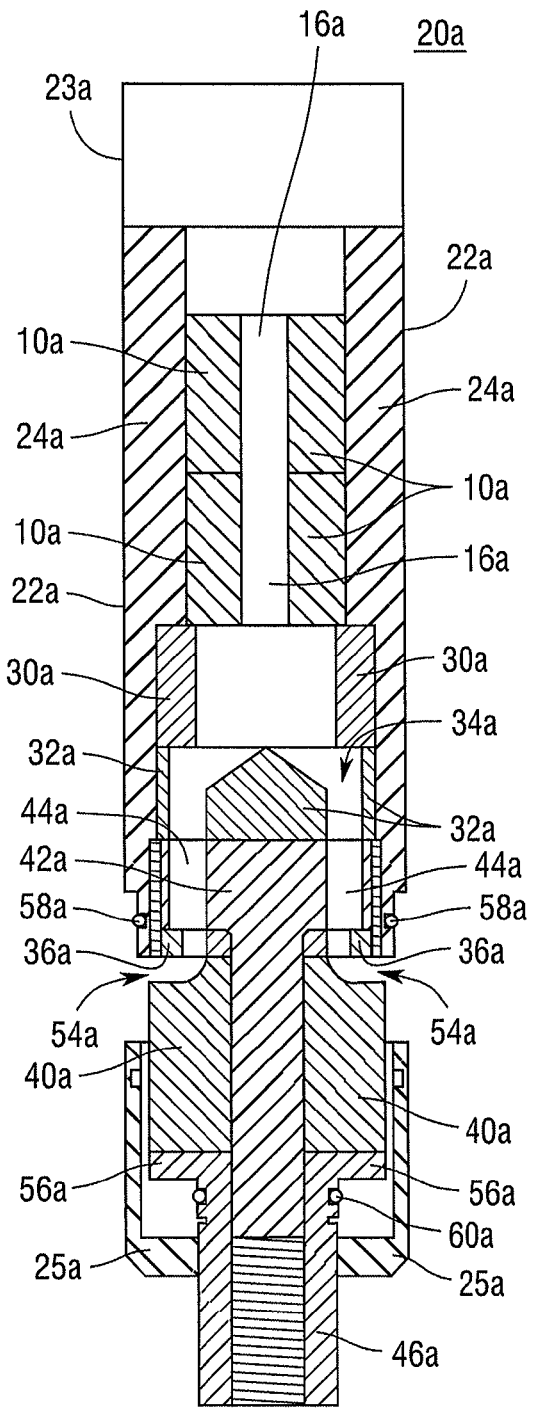
FIG. 9 shows a cross-sectional side view of the cutting apparatus of FIG. 7 with the sleeve section in the open position.

A second embodiment of the cutting apparatus 20*a* is shown in FIGS. 7 through 9. All elements of cutting apparatus 20*a* are the same as the previous embodiment, except the retainer 36*a* does not have a constrictor portion and the diverter 40*a* does not have a chamfer. In this embodiment, the burrow holes 48*a* are narrower than the burrow holes of the previous embodiment, increasing the Kn and pressure and velocity of the flow of heated gas passing through. The rounded surface portion 52*a* of the diverter 40*a* more gradually directs the flow of heated gas to project radially between the circumferential diverter gap 54*a* than the previous embodiment. The circumferential diverter gap 54*a* is also formed by the space between the retainer 36*a* and edge of the rounded surface portion 52*a* of the diverter 40*a*, instead of the space between the tip of the constructor portion and edge of the rounded surface portion of the diverter.

Once passing through the burrow holes 48*a*, the flow of heated gas is directed by the rounded surface portion 52*a* of the diverter 40*a* outward, projecting radially through the circumferential diverter gap 54*a*. While the flow of heated gas passes through the circumferential diverter gap 54*a*, the Kn reaches its highest level. The pressure and velocity of the distributed flow of heated gas is so high that it causes the distributed flow of heated gas passing through the circumferential diverter gap 54*a* to immediately flow back together, becoming a singular flow, as if there was no distribution by the plurality of through holes 34*a* anywhere in the cutting apparatus 20. Bringing the flow back together in this manner increases the strength of the flow of heated gas. The circumferential diverter gap 54*a* allows the flow of heated gas to cut through and sever the conduit 26*a* in a very concentrated and narrow area.

Another limitation found in the prior art cutting systems is that loose powder of thermite formula must be packed into the axial holes of the thermite pellets so ignition of the cutting apparatus can occur. The loose powder would first be ignited by some kind of igniting mechanism and would then cause the thermite pellets to ignite from the heated gas formed by the loose powder. Packing the axial holes with loose powder is problematic because the loose powder tends to create blockages in the axial holes that hinder the pressure and velocity of the flow of heated gas as it travels through the cutting mechanism. This causes the flow of gas to reach the nozzle assembly unevenly. Packing the axial holes with loose powder also causes safety issues and problems in transporting the cutting system to the job site, as will be discussed in more detail below.

Figure 10:
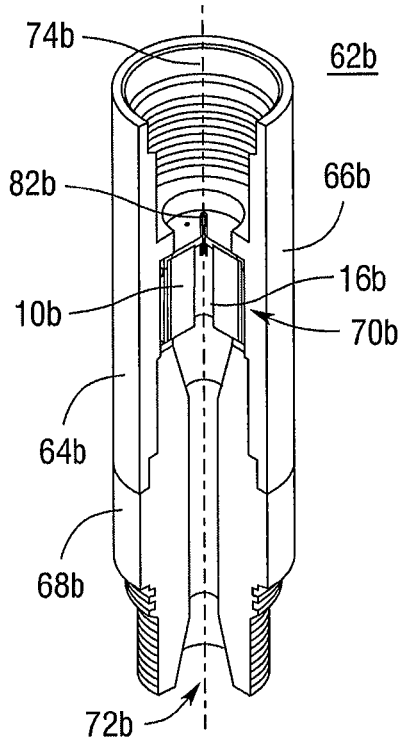
FIG. 10 shows a perspective cut-out view of a high power igniter that connects to the cutting apparatus.
Figure 11:
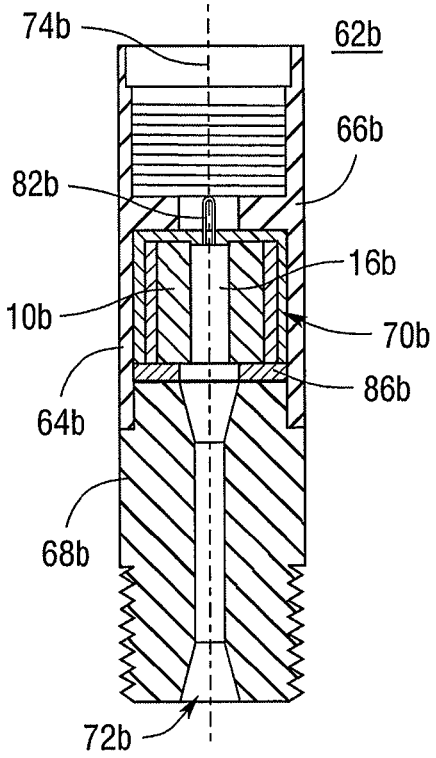
FIG. 11 shows a cross-sectional side view of the high power igniter of FIG. 10.
Figure 12:
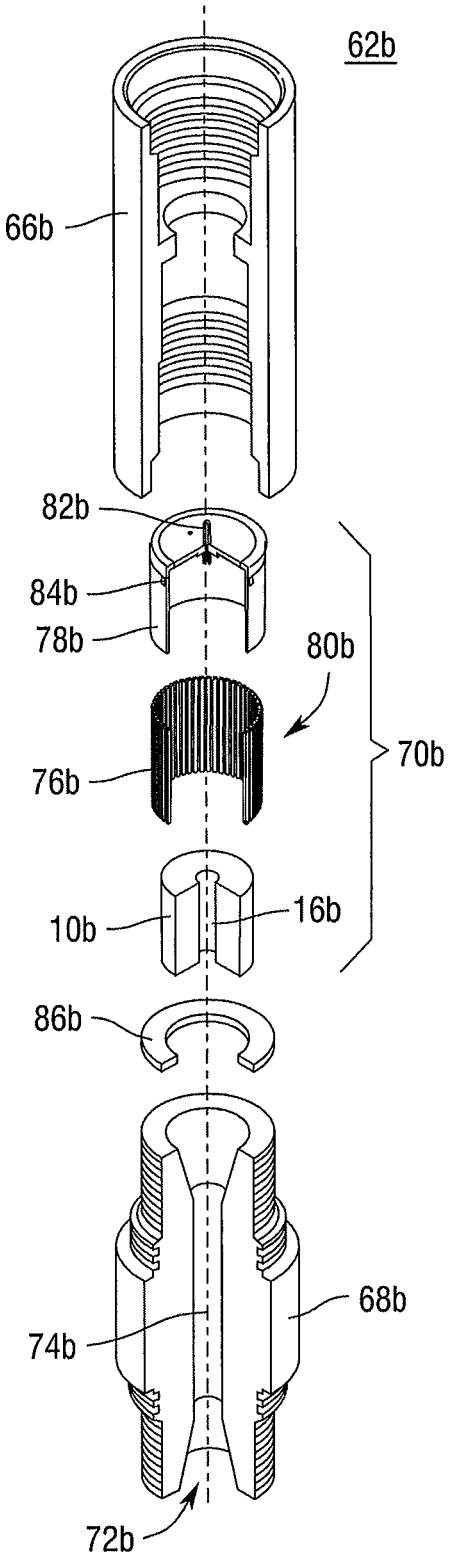
FIG. 12 shows an exploded perspective cut-out view of the high power igniter of FIG. 10.

In order to ignite the metal magnalium thermite pellets in the cutting assembly, some source of heat is required. FIGS. 10 through 12 shows a high power igniter 62*b* that performs this function without the need for packing loose powder into the axial holes of thermite pellets and associated problems. The high power igniter 62*b* releasably and slidably secures to the cutting apparatus through the igniter docking section. When activated, the high power igniter 62*b* ignites a metal magnalium thermite pellet 10*b*, which forces a high pressure flow of heated gas into the cutting apparatus (described above) to immediately and directly ignite the metal magnalium thermite pellets within the cutting apparatus. Upon entering the cutting apparatus, the flow of heated gas from the high power igniter 62*b* goes through the axial holes, around the sides, and in the spaces between each metal magnalium thermite pellet almost immediately, causing the total surface area of all metal magnalium thermite pellets to be engulfed with the flow of heated gas.

The metal magnalium thermite pellet 10*b* is quickly and easily loaded into the high power igniter 62*b*. The high power igniter 62*b* ignites the flow of heated gas into the cutting apparatus through the use of a mechanical high wattage heater 70*b*. Using a mechanical device to ignite the flow of heated gas, the high power igniter 62*b* adds an additional level of safety not seen in prior art igniters that use pyrotechnics to ignite the flow of heated gas.

The high power igniter 62*b* comprises an igniter housing 64*b* made from hardened steel and is adapted to be positioned in the conduit (not shown), similar to the cutting apparatus discussed above. The igniter housing 64*b* itself comprises a containment sub 66*b* and a nozzle sub 68*b*. The containment sub 66*b* and nozzle sub threadably secure to each other so as to be releasable from each other. This allows for quick and easy reloading of the high wattage heater 70*b*. The end of the nozzle sub 68*b* not securable to the containment sub 66*b* connects to the cutting apparatus.

The nozzle sub 68*b* has an orifice 72*b* through its central axis 74*b*, which is tapered on both ends. The orifice 72*b* regulates the pressure and velocity of the flow of heated gas and directs the flow of heated gas towards the cutting apparatus, after the high power igniter 62*b* has been activated. It should be understood the cross-sectional surface area of the orifice 72*b* may be changed to manipulate the Kn. A higher Kn will cause the flow of heated gas to travel farther from the orifice 72*b*, allowing there to be more space between the high power igniter 62*b* and cutting apparatus if needed.

The containment sub 66*b* provides a pressure sealed housing for the high wattage heater 70*b*. The end of the containment sub 66*b* not secured to the nozzle sub 68*b* secures to a cable head assembly (not shown) and cables (not shown) that connects the high power igniter 62*b*, as well as the entire cutting system, to an external power source (not shown). The cable head assembly is secured to the high power igniter 62*b* in such a way that the cables are used to position and dangle the high power igniter 62*d* in the conduit (not shown) at the location to be cut. The external power source sends a charge to the high power igniter 62*b* through the cables that will activate the high wattage heater 70*b*.

The high wattage heater 70*b* comprises a metal magnalium thermite pellet 10*b*, discussed above, a pellet igniting device 76*b*, which is a length of resistance wire, an insulation sleeve 78*b*, and a heat tube 80*b*. Through empirical testing it has been found that high wattage wire wound heaters can be used as pellet igniting device 76*b* if the high wattage wire is wrapped around metal magnalium thermite pellet 10*b*. While these same high wattage wire wound heaters could also ignite loose powdered thermite, they require more energy to ignite a compressed metal magnalium thermite pellet 10*b*. This serves as an additional safety feature over prior art igniters that use loose powdered thermite as a heat source. The preferred high wattage wire is a 31 gauge nichrome wire. One of the benefits of the pellet igniting device 76*b* being a high wattage wire wound heaters is that in order for these pellet igniting devices 76*b* to ignite the metal magnalium thermite pellet 10*b*, a very narrow range of current is required: too much current and the pellet igniting device 76*b* burns out within a few seconds—far too short to effect the ignition of the metal magnalium thermite pellet 10*b*; too little current and the pellet igniting device 76*b* will not heat up high enough to achieve the ignition temperature of the metal magnalium thermite pellet 10*b*.

When the high power igniter 62*b* is constructed for use, the metal magnalium thermite pellet 10*b* is encapsulated in the insulation sleeve 78*b*. The insulation sleeve 78*b* has an open end that faces towards the nozzle sub 68*b*, so that when the metal magnalium thermite pellet 10*b* is ignited the flow of heated gas is directed correctly. On the end opposite from the one that is open, the insulation sleeve 78*b* comprises an electrical contact 82*b* and ground clip 84*b* that both directly work in conjunction with the cable head assembly secured to the containment sub 66*b*. The electrical contact 82*b* and ground clip 84*b* allow the charge from the external power source to meet with the pellet igniting device 76*b*. A containment seal 86*b* is used to secure the metal magnalium thermite pellet 10*b* in the igniter housing.

Interposed between the metal magnalium thermite pellet 10*b* and insulation sleeve 78*b* is the pellet igniting device and heat tube 80*b*. The pellet igniting device 76*b* is wrapped longitudinally around the entire perimeter of the heat tube 80*b* and is connected to both the electrical contact 82*b* and ground clip 84*b*. The pellet igniting device and heat tube 80*b* slide into the insulation sleeve 78*b* and the metal magnalium thermite pellet 10*b* slides into the pellet igniting device and heat tube 80*b*. The heat tube 80*b* is fireproof and non-conductive, so that it can withstand the heat generated from the flow of heated gas and will not unduly transmit electrical current when the pellet igniting device 76*b* is activated. In addition to its function above, the containment seal 86*b* also prevents the pellet igniting device 76*b* from making contact with the nozzle sub 68*b* or containment sub 66*b*.

When the external power source sends the charge to the high power igniter 62*b*, the charge goes through the cable head assembly, electrical contact 82*b*, and into the pellet igniting device 76*b*. Due to the characteristics of the resistance wire used, the pellet igniting device 76*b* heats up to a high temperature and subsequently heats the metal magnalium thermite pellet 10*b*. Once it reaches a high enough temperature, the metal magnalium thermite pellet 10*b* will spontaneously ignite and create the flow of heated gas to be directed towards the cutting apparatus, as discuss above.

Figure 13:
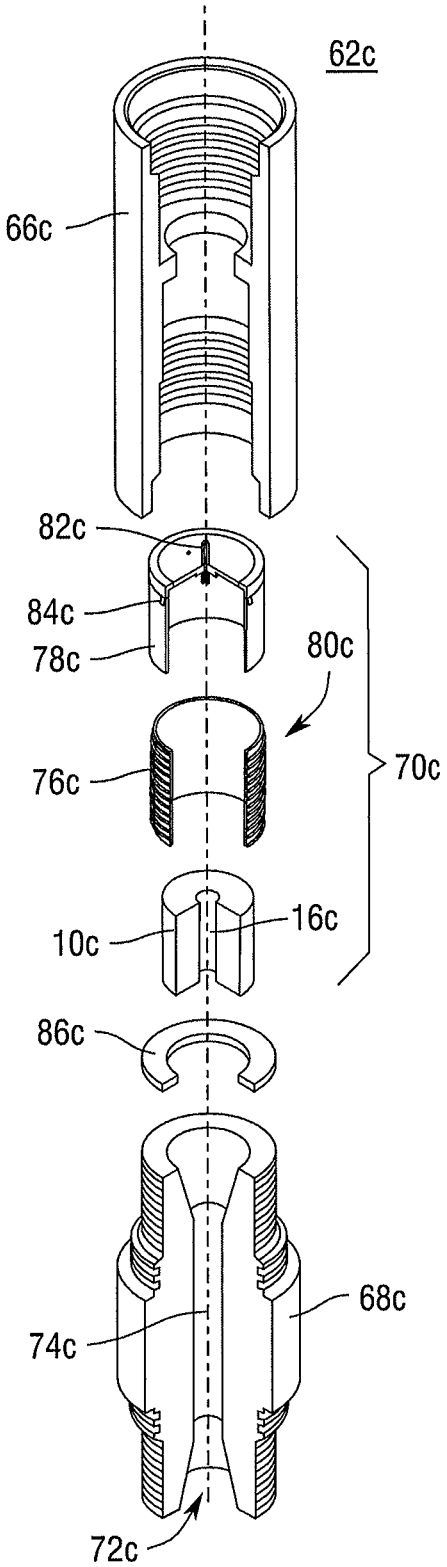
FIG. 13 shows an exploded perspective cut-out view of another embodiment of the high power igniter that connects to the cutting apparatus.

Another embodiment of the high power igniter 62*c* is shown in FIG. 13. High power igniter 62*c* comprises all the elements of the previous embodiment and in the same orientation. Except in this embodiment, the pellet igniting device 76*c* is affixed externally, lengthwise, around the outer surace of the heat tube 80*c* and is connected to both the electrical contact 82*c* and ground clip 84*c*. The pellet igniting device 76*c* is typically affixed by an enamel or fire resistant epoxy, but any means of affixing the pellet igniting device 76*c* to the heat tube 80*c* may work. The pellet igniting device and heat tube 80*c* slide into the insulation sleeve 78*c* and the metal magnalium thermite pellet 10*c* slides into the pellet igniting device and heat tube 80*c*.

Figure 14:
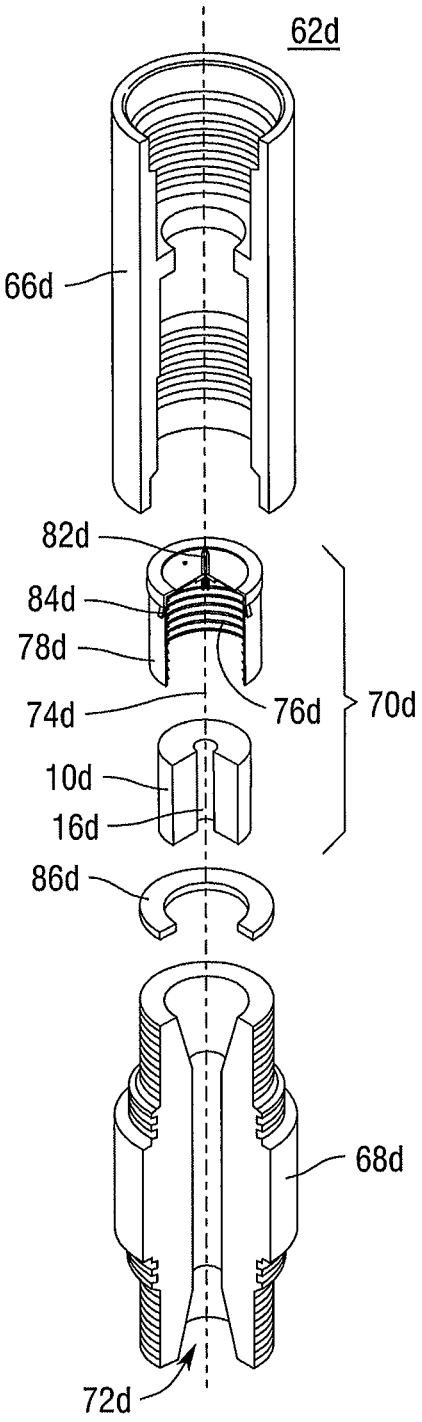
FIG. 14 shows an exploded perspective cut-out view of another embodiment of the high power igniter that connects to the cutting apparatus.

Another embodiment of the high power igniter 62*d* is shown in FIG. 14. In this embodiment, the high wattage heater 70*d* comprises a metal magnalium thermite pellet 10*d*, discussed above, a pellet igniting device 76*d*, which is a length of resistance wire, and an insulation sleeve 78*d*. When the high power igniter 62*d* is constructed for use, the metal magnalium thermite pellet 10*d* is encapsulated in the insulation sleeve 78*d*. The insulation sleeve 78*d* has an open end that faces towards the nozzle sub 68*d*. On the end opposite from the one that is open, the insulation sleeve 78*d* comprises an electrical contact 82*d* and ground clip 84*d* that both directly work in conjunction with the cable head assembly secured to the containment sub 66*d*. The electrical contact 82*d* and ground clip 84*d* allow the charge from the external power source to meet with the pellet igniting device 76*d*. A containment seal 86*d* is used to secure the metal magnalium thermite pellet 10*d* in the igniter housing.

Affixed lengthwise to the inner surface of the insulation sleeve 78*d* is the pellet igniting device. The pellet igniting device 76*d* is connected to both the electrical contact 82*d* and ground clip 84*d*. The pellet igniting device 76*d* is typically affixed by an enamel or fire resistant epoxy, but any means of affixing the pellet igniting device 76*d* to the inner surface of the insulation sleeve 78*d* may work. The metal magnalium thermite pellet 10*d* slides directly into the insulation sleeve 78*d* and pellet igniting device 76*d*.

When the external power source sends the charge to the high power igniter 62*d*, the charge goes through the cable head assembly, electrical contact 82*d*, and into the pellet igniting device 76*d*. Due to the characteristics of the resistance wire used, the pellet igniting device 76*d* heats up to a high temperature and subsequently heats the metal magnalium thermite pellet 10*d*. Once it reaches a high enough temperature, the metal magnalium thermite pellet 10*d* will spontaneously ignite and create the flow of heated gas to be directed towards the cutting apparatus, as discuss above.

Figure 15:
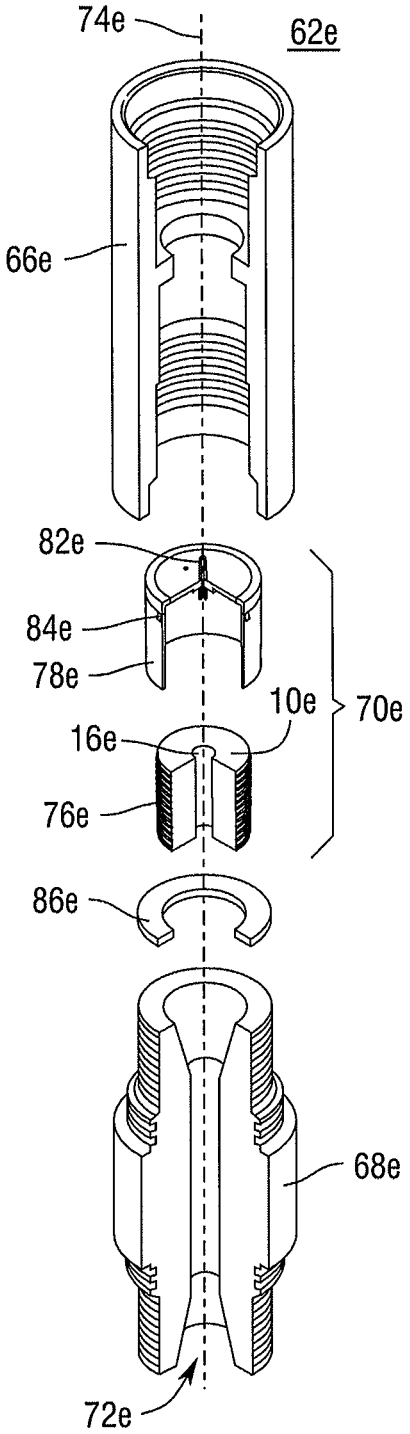
FIG. 15 shows an exploded perspective cut-out view of another embodiment of the high power igniter that connects to the cutting apparatus.

Another embodiment of the high power igniter 62*e* is shown in FIG. 15. In this embodiment, the high wattage heater 70*e* comprises a metal magnalium thermite pellet 10*e*, discussed above, a pellet igniting device 76*e*, which is a length of resistance wire, and an insulation sleeve 78*e*. When the high power igniter 62*e* is constructed for use, the metal magnalium thermite pellet 10*e* with the pellet igniting device 76*e* affixed directly on its outer surface is encapsulated in the insulation sleeve 78*e*. The pellet igniting device 76*e* is typically affixed by an enamel or fire resistant epoxy, but any means of affixing the pellet igniting device 76*e* to the outer surface of the metal magnalium thermite pellet 10*e* may work.

The insulation sleeve 78*e* has an open end that faces towards the nozzle sub 68*e*. On the end opposite from the one that is open, the insulation sleeve 78*e* comprises an electrical contact 82*e* and ground clip 84*e* that both work in conjunction with the cable head assembly secured to the containment sub 66*e*. The pellet igniting device 76*e* is connected to both the electrical contact 82*e* and ground clip 84*e*. Both the metal magnalium thermite pellet 10*e* and its affixed pellet igniting device 76*e* slide directly into the insulation sleeve 78*e*. A containment seal 86*e* is used to secure the metal magnalium thermite pellet 10*e* in the igniter housing.

When the external power source sends the charge to the high power igniter 62*e*, the charge goes through the cable head assembly, electrical contact 82*e*, and into the pellet igniting device 76*e*. Due to the characteristics of the resistance wire used, the pellet igniting device 76*e* heats up to a high temperature and subsequently heats the metal magnalium thermite pellet 10*e*. Once it reaches a high enough temperature, the metal magnalium thermite pellet 10*e* will spontaneously ignite and create the flow of heated gas to be directed towards the cutting apparatus, as discuss above.

Figure 16:
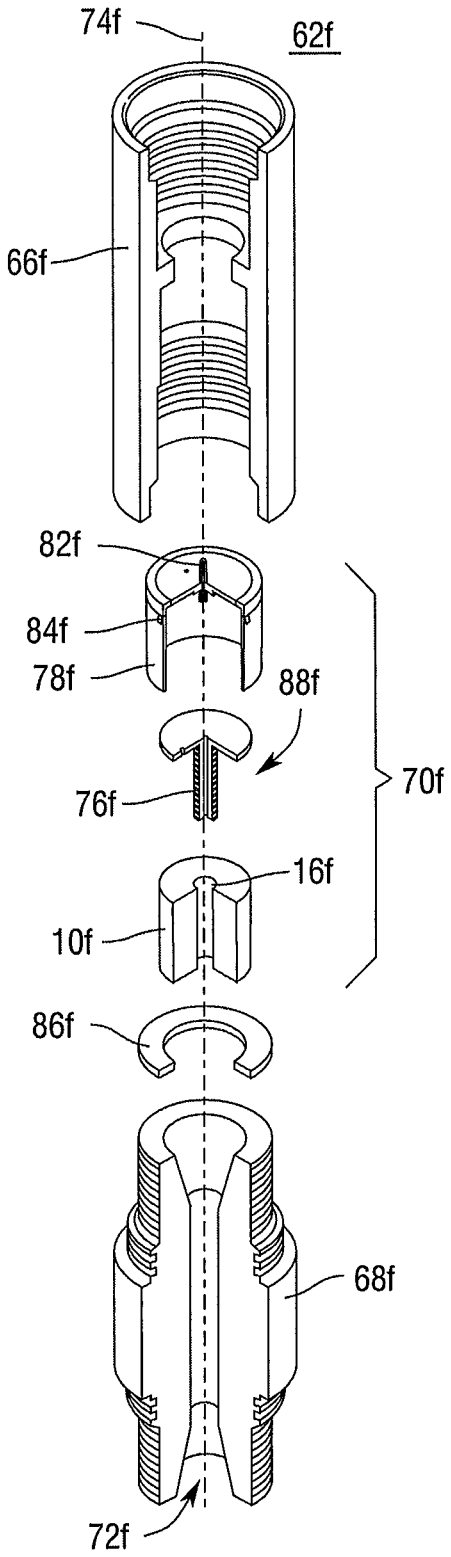
FIG. 16 shows an exploded perspective cut-out view of another embodiment of the high power igniter that connects to the cutting apparatus.

Another embodiment of the high power igniter 62*f* is shown in FIG. 16. In this embodiment, the high wattage heater 70*f* comprises a metal magnalium thermite pellet 10*f*, discussed above, a pellet igniting device 76*f*, which is a length of resistance wire, an insulation sleeve 78*f*, and a heat shaft 88*f*. When the high power igniter 62*f* is constructed for use, the metal magnalium thermite pellet 10*f* is encapsulated in the insulation sleeve 78*f*. The insulation sleeve 78*f* has an open end that faces towards the nozzle sub 68*f*, so that when the metal magnalium thermite pellet 10*f* is ignited the flow of heated gas is directed correctly. On the end opposite from the one that is open, the insulation sleeve 78*f* comprises an electrical contact 82*f* and ground clip 84*f* that work in conjunction with the cable head assembly secured to the containment sub 66*f*. A containment seal 86*f* is used to secure the metal magnalium thermite pellet 10*f* in the igniter housing.

Affixed to the metal magnalium thermite pellet 10*f* through its axial hole 16*f* is the pellet igniting device and heat shaft 88*f*. The pellet igniting device 76*f* is fixedly wrapped around the majority of the heat shaft 88*f* and is connected to both the electrical contact 82*f* and ground clip 84*f*. The pellet igniting device 76*f* is typically affixed by an enamel or fire resistant epoxy, but any means of fixedly wrapping the pellet igniting device 76*f* to the heat shaft 88*f* may work. The heat shaft 88*f* is fireproof and non-conductive, so that it can withstand the heat created by the pellet igniting device 76*f* and flow of heated gas and will not unduly transmit electrical current when the pellet igniting device 76*f* is activated. In addition to its function above, the containment seal 86*f* also prevents the pellet igniting device 76*f* from making contact with the nozzle sub 68*f* or containment sub 66*f*.

When the external power source sends the charge to the high power igniter 62*f*, the charge goes through the cable head assembly, electrical contact 82*f*, and into the pellet igniting device 76*f*. Due to the characteristics of the resistance wire used, the pellet igniting device 76*f* heats up to a high temperature and subsequently heats the body of the metal magnalium thermite pellet 10*f* surrounding it. Once it reaches a high enough temperature, the metal magnalium thermite pellet 10*f* will spontaneously ignite and create the flow of heated gas to be directed towards the cutting apparatus, as discuss above. It should be understood that in this embodiment, the metal magnalium thermite pellet 10*f* must have the axial hole 16*f* through the central axis 74*f*, other embodiments may not need this limitation to function properly.

Figure 17:
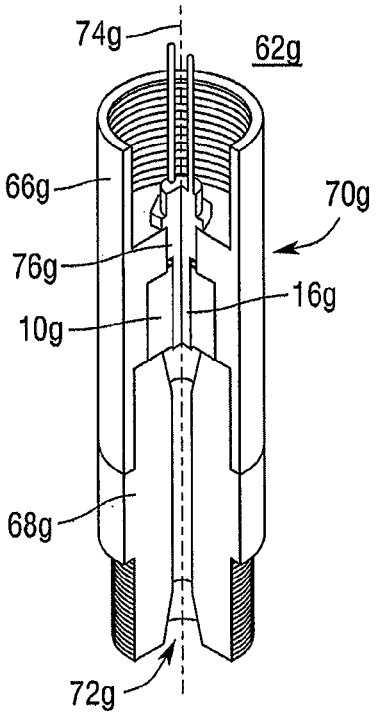
FIG. 17 shows a perspective cut-out view of another embodiment of the high power igniter that connects to the cutting apparatus.

Another embodiment of the high power igniter 62*g* is shown in FIG. 17. In this embodiment, the high wattage heater 70*g* comprises a metal magnalium thermite pellet 10*g*, discussed above, and a pellet igniting device 76*g*, which is a cartridge heater. The pellet igniting device 76*g* is different from the wires described above: it is as commercial cylindrical wire wound high wattage cartridge/insertion heaters manufactured by Watlow Corp. These pellet igniting devices 76*g* are available in shapes and sizes that enable them to fit within the axial hole 16*g* of the metal magnalium thermite pellet 10*g*. These pellet igniting devices 76*g* are safe for use in electromagnetic fields because of their high inductance and large power requirements. In order for these pellet igniting devices 76*g* to ignite the metal magnalium thermite pellet 10*g*, a very narrow range of current is required: too much current and the pellet igniting device 76*g* burns out within a few seconds—far too short to effect the ignition of the metal magnalium thermite pellet 10*g*; too little current and the pellet igniting device 76*g* will not heat up high enough to achieve the ignition temperature of the metal magnalium thermite pellet 10*g*. When the high power igniter 62*g* is constructed for use, the metal magnalium thermite pellet 10*g* is encapsulated in the containment sub 66*g*. The pellet igniting device 76*g* is threadably secured to the containment sub 66*g* and affixed to the metal magnalium thermite pellet 10*g* through its axial hole 16*g*.

When the external power source sends the charge to the high power igniter 62*g*, the charge goes through the cable head assembly and directly into the pellet igniting device 76*g*. Due to the characteristics of the cartridge heater, the pellet igniting device 76*g* heats up to a high temperature and subsequently heats the body of the metal magnalium thermite pellet 10*g* surrounding it. Once it reaches a high enough temperature, the metal magnalium thermite pellet 10*g* will spontaneously ignite and create the flow of heated gas to be directed towards the cutting apparatus, as discuss above. It should be understood that in this embodiment, the metal magnalium thermite pellet 10*g* must have the axial hole 16*g* through the central axis 74*g*, other embodiments may not need this limitation to function properly.

Figure 18:
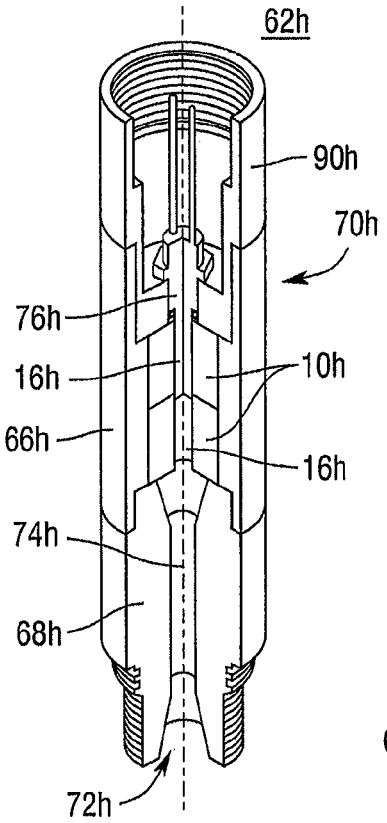
FIG. 18 shows a perspective cut-out view of another embodiment of the high power igniter that connects to the cutting apparatus.

Another embodiment of the high power igniter 62*h* is shown in FIG. 18. In this embodiment, the high wattage heater 70*h* comprises a metal magnalium thermite pellet 10*h*, discussed above, a threaded segment 90*h*, and a pellet igniting device 76*h*, which is a cartridge heater. When the high power igniter 62*h* is constructed for use, the metal magnalium thermite pellet 10*h* is encapsulated in the containment sub 66*h*. The threaded segment 90*h* is threadably secured to the containment sub 66*h*. The pellet igniting device 76*h* is threadably secured to the threaded segment 90*h* and affixed to the metal magnalium thermite pellet 10*h* through its axial hole 16*h*.

When the external power source sends the charge to the high power igniter 62*h*, the charge goes through the cable head assembly and into the pellet igniting device 76*h*. Due to the characteristics of the cartridge heater, the pellet igniting device 76*h* heats up to a high temperature and subsequently heats the body of the metal magnalium thermite pellet 10*h* surrounding it. Once it reaches a high enough temperature, the metal magnalium thermite pellet 10*h* will spontaneously ignite and create the flow of heated gas to be directed towards the cutting apparatus, as discuss above. It should be understood that in this embodiment, the metal magnalium thermite pellet 10*h* must have the axial hole 16*h* through the central axis 74*h*, other embodiments may not need this limitation to function properly.

Figure 19:
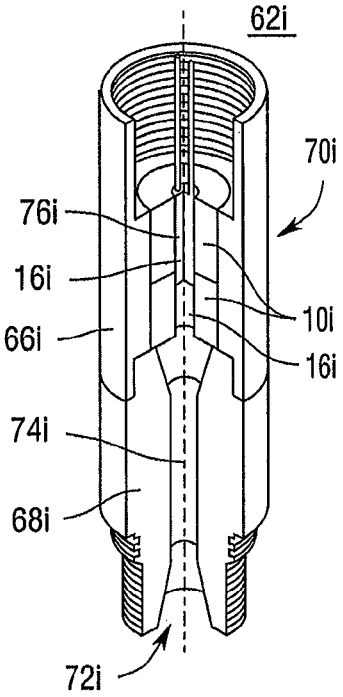
FIG. 19 shows a perspective cut-out view of another embodiment of the high power igniter that connects to the cutting apparatus.

Another embodiment of the high power igniter 62*i* is shown in FIG. 19. In this embodiment, the high wattage heater 70*i* comprises a metal magnalium thermite pellet 10*i*, discussed above, and a pellet igniting device 76*i*, which is a cartridge heater. When the high power igniter 62*i* is constructed for use, the metal magnalium thermite pellet 10*i* is positioned in the containment sub 66*i*. The pellet igniting device 76*i* is directly affixed to the metal magnalium thermite pellet 10*i* through its axial hole 16*i*.

When the external power source sends the charge to the high power igniter 62*i*, the charge goes through the cable head assembly and into the pellet igniting device 76*i*. Due to the characteristics of the cartridge heater, the pellet igniting device 76*i* heats up to a high temperature and subsequently heats the body of the metal magnalium thermite pellet 10*i* surrounding it. Once it reaches a high enough temperature, the metal magnalium thermite pellet 10*i* will spontaneously ignite and create the flow of heated gas to be directed towards the cutting apparatus, as discuss above. It should be understood that in this embodiment, the metal magnalium thermite pellet 10*i* must have the axial hole 16*i* through the central axis 74*i*, other embodiments may not need this limitation to function properly.

Figure 20:
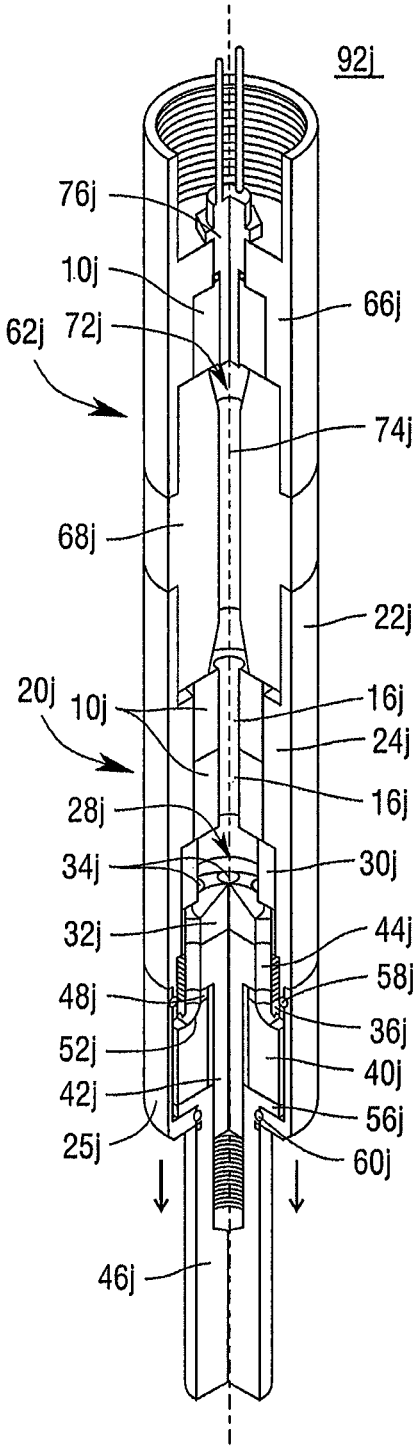
FIG. 20 shows a perspective cut-out view of the system for radially projecting a flow of heated gas.
Figure 21:
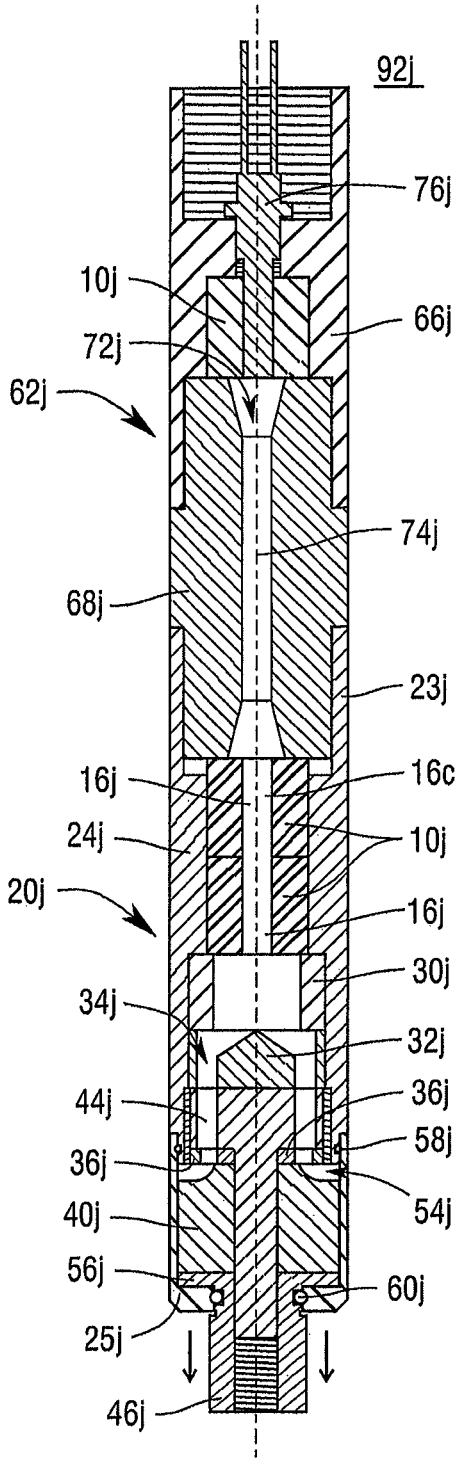
FIG. 21 shows a cross-sectional side view of the system of FIG. 20.

The entire cutting system 92*j* is shown in FIGS. 20 and 21. As disclosed, the embodiment of the high power igniter 62*j* comprises the pellet igniting device 76*j*, which is a cartridge heater threadably secured to the containment sub 66*j* and directly affixed to the axial hole 16*j* of the metal magnalium thermite pellet 10*j*. However, it should be understood that the cutting system 92*j* may incorporate any embodiment of the high power igniter 62*j* disclosed in this patent application and obvious variations thereof. The embodiment of the cutting apparatus 20*j* is the embodiment that does not comprise the chamfer on the diverter 40*j* or the constrictor portion extending from the retainer 36*j*. Again, it should be understood that any embodiment of the cutting apparatus 20*j* disclosed herein, or obvious variations thereof, may be incorporated into the cutting system 92*j*.

Another limitation associated with prior art cutting systems is that these systems must be fully assembled and ready for activation prior to being transported to the job site. In the prior art, thermite pellets and loose powder of thermite formula are packed into cutting apparatuses and igniters and then sealed. Sealing in the thermite pellets and loose powder of thermite formula is needed for safety purposes. Since these cutting apparatuses and igniters are transported fully assembled, they still may be accidentally activated during their transportation, which keeps these cutting apparatuses and igniters from being able to pass certain government safety regulations.

Prior art igniters are limited to using a small quantity of loose powdered thermite formula to pass government regulations. This limits the igniters to require loose powder in the axial holes of the pellets contained in the cutting apparatus, in order to be able to ignite the pellets. In certain instances, these prior art cutting apparatuses and igniters will misfire or not produce flows of heated gas that can cut through a conduit. The aid of the loose powder of thermite formula is needed in these prior art devices as an essential catalyst needed to activate the thermite pellets or they are unable to function with any certainty.

Because the cutting system 92*j* is able to be activated without the assistance of the loose thermite powder, the metal magnalium thermite pellets 10*j* used in the cutting system 92*j* are themselves granted a UN1325 sec 4.1 flammable solid classification by the U.S. Department of Transportation and may be packaged separately from the cutting system 92*j*. The metal magnalium thermite pellets 10*j* may then be inserted into the high power igniter 62*j* and cutting apparatus 20*j* at the job site. Separately packaging the metal magnalium thermite pellets 10*j* from the rest of the cutting system 92*j* allows the metal magnalium thermite pellets 10*j* to be placed by themselves during transportation, either in a separate carrier or in a separate location in the same carrier, which greatly improves the safety during transportation. The cutting system 92*j* is safe enough to be granted a UN1325 sec 4.1 flammable solid classification by the U.S. Department of Transportation.

The steps needed to safely transport and use the high power igniter 62*j* are as follows —convey the metal magnalium thermite pellets 10*j* to the job site where the conduit is to be cut, convey the high power igniter 62*j* in a separate location from the metal magnalium thermite pellets 10*j* to the same job site, assemble the high power igniter 62*j* at the job site by inserting the metal magnalium thermite pellets 10*j* into the containment sub 66*j* of the high power igniter 62*j*, connect the high power igniter 62*j* to the external power source (not shown), releasably join the high power igniter 62*j* to the cutting apparatus 20*j* to create the cutting system 92*j*, and then activate the cutting system 92*j* through the external power source. Similarly, the steps needed to safely transport and use the cutting apparatus 20*j* are as follows—convey the metal magnalium thermite pellets 10*j* to the job site where the conduit is to be cut, convey the cutting apparatus 20*j* in a separate location from the metal magnalium thermite pellets 10*j* to the same job site, have a conduit cutting specialist determine the characteristics of the conduit to be cut, assemble the cutting apparatus 20*j* by inserting the appropriate number of metal magnalium thermite pellets 10*j* into the cutting apparatus 20*j* at the job site based on those conduit characteristics, and releasably join the cutting apparatus 20*j* to the high power igniter 62*j* to create the assembled cutting system 92*j*. Once the cutting system 92*j* has been assembled, the cutting apparatus 20*j* can be positioned down into the conduit at the appropriate location to be cut and the cutting apparatus 20*j* is activated by sending a charge to the high power igniter 62*j* through the external power source.

This invention has been described with reference to several preferred embodiments. Many modifications and alterations will occur to others upon reading and understanding the preceding specification. It is intended that the invention be construed as including all such alterations and modifications in so far as they come within the scope of the appended claims or the equivalents of these claims.

The invention claimed is:

1. A method of safely transporting a high power igniter that releasably secures to a cutting apparatus, the cutting apparatus for radially projecting a flow of heated gas to cut from an internal surface through an external surface of a conduit, the conduit for oil, gas, mining, and underwater pressure sealed tool applications, the method comprising:

conveying a metal magnalium thermite pellet to a job site;

conveying the high power igniter to the job site separately from the metal magnalium thermite pellet; and assembling the high power igniter at the job site by inserting the metal magnalium thermite pellet into the high power igniter.

2. The method of safely transporting a high power igniter of claim 1 further comprising connecting the high power igniter to an external power source and using the external power source to activate the high power igniter.

3. The method of safely transporting a high power igniter of claim 1 wherein the metal magnalium thermite pellet has a composition by weight consisting of:

between 1 to 44 percent magnalium alloy;

between 1 to 44 percent aluminum;

between 40 to 60 percent iron oxide; and between 10 to 20 percent polytetrafluoroethylene.

4. The method of safely transporting a high power igniter of claim 1 wherein the metal magnalium thermite pellet has a composition by weight that is:

17.5 percent magnalium alloy;

17.5 percent aluminum;

50 percent iron oxide; and 15 percent polytetrafluoroethylene.

5. The method of safely transporting a high power igniter of claim 1 wherein the metal magnalium thermite pellet comprises a magnalium alloy having a composition by weight of 50 percent magnesium and 50 percent aluminum.

6. The method of safely transporting a high power igniter of claim 1 wherein the metal magnalium thermite pellet is compacted to between 90 percent and 99 percent of its theoretical density.

7. A method of safely transporting a cutting apparatus, the cutting apparatus for radially projecting a flow of heated gas to cut from an internal surface through an external surface of a conduit, the conduit for oil, gas, mining, and underwater pressure sealed tool applications, the method comprising:

conveying a metal magnalium thermite pellet to a job site;

conveying the cutting apparatus to the job site separately from the metal magnalium thermite pellet; and assembling the cutting apparatus at the job site by inserting the metal magnalium thermite pellet into the cutting apparatus.

8. The method of safely transporting a cutting apparatus of claim 7 further comprising determining the number of metal magnalium thermite pellets to be inserted into the cutting apparatus.

9. The method of safely transporting a cutting apparatus of claim 7 further comprising determining the number of metal magnalium thermite pellets to be inserted into the cutting apparatus based on the characteristics of the conduit to be cut.

10. The method of safely transporting a cutting apparatus of claim 7 wherein the metal magnalium thermite pellet has a composition by weight consisting of:

between 1 to 44 percent magnalium alloy;

between 1 to 44 percent aluminum;

between 40 to 60 percent iron oxide; and between 10 to 20 percent polytetrafluoroethylene.

11. The method of safely transporting a cutting apparatus of claim 7 wherein the metal magnalium thermite pellet has a composition by weight that is:

17.5 percent magnalium alloy;

17.5 percent aluminum;

50 percent iron oxide; and 15 percent polytetrafluoroethylene.

12. The method of safely transporting a cutting apparatus of claim 7 wherein the metal magnalium thermite pellet comprises a magnalium alloy having a composition by weight of 50 percent magnesium and 50 percent aluminum.

13. The method of safely transporting a cutting apparatus of claim 7 wherein the metal magnalium thermite pellet is compacted to between 90 percent and 99 percent of its theoretical density.

14. A method of using a cutting apparatus for radially projecting a flow of heated gas to cut from an internal surface through an external surface of a conduit, the conduit for oil, gas, mining, and underwater pressure sealed tool applications, the method comprising:

conveying a plurality of metal magnalium thermite pellets to a job site;

conveying the cutting apparatus to the job site separately from the plurality of metal magnalium thermite pellets;

determining the number of metal magnalium thermite pellets to be inserted into the cutting apparatus based on the characteristics of the conduit to be cut; and inserting at least one of the plurality of metal magnalium thermite pellets into the cutting apparatus based on the determination on the characteristics of the conduit to be cut.

15. The method of using a cutting apparatus of claim 14 further comprising positioning the cutting apparatus in the conduit to a location to be cut.

16. The method of using a cutting apparatus of claim 14 further comprising:

positioning the cutting apparatus in the conduit to a location to be cut; and activating the cutting device by sending a charge to the cutting device from an external power source.

17. The method of using a cutting apparatus of claim 14 wherein each of the plurality of metal magnalium thermite pellets has a composition by weight consisting of:

between 1 to 44 percent magnalium alloy;
between 1 to 44 percent aluminum;
between 40 to 60 percent iron oxide; and
between 10 to 20 percent polytetrafluoroethylene.

18. The method of using a cutting apparatus of claim 14 wherein each of the plurality of metal magnalium thermite pellets has a composition by weight that is:

17.5 percent magnalium alloy;
17.5 percent aluminum;
50 percent iron oxide; and
15 percent polytetrafluoroethylene.

19. The method of using a cutting apparatus of claim 14 wherein each of the plurality of metal magnalium thermite pellets comprises a magnalium alloy having a composition by weight of 50 percent magnesium and 50 percent aluminum.

20. The method of using a cutting apparatus of claim 14 wherein each of the plurality of metal magnalium thermite pellets is compacted to between 90 percent and 99 percent of its theoretical density.

* * * * *